US007367075B2

(12) United States Patent
Kim

(10) Patent No.: US 7,367,075 B2
(45) Date of Patent: May 6, 2008

(54) GIRDER BRIDGE PROTECTION DEVICE USING SACRIFICE MEMBER

(75) Inventor: Sang-hyo Kim, Seoul (KR)

(73) Assignee: Industry-Academic Cooperation Foundation Yonsei University, Seoul (KR)

( * ) Notice: Subject to any disclaimer, the term of this patent is extended or adjusted under 35 U.S.C. 154(b) by 339 days.

(21) Appl. No.: 10/543,147

(22) PCT Filed: Jul. 1, 2005

(86) PCT No.: PCT/KR2005/002098

§ 371 (c)(1),
(2), (4) Date: Jul. 25, 2005

(87) PCT Pub. No.: WO2007/001103

PCT Pub. Date: Jan. 4, 2007

(65) Prior Publication Data

US 2007/0000078 A1 Jan. 4, 2007

(51) Int. Cl.
*E04B 1/98* (2006.01)

(52) U.S. Cl. ..... 14/73.5; 14/74.5; 52/167.1; 52/167.4

(58) Field of Classification Search ..... 52/167.1, 52/167.3, 167.4; 14/73.5, 74.5, 78
See application file for complete search history.

(56) References Cited

U.S. PATENT DOCUMENTS 5,533,307 A * 7/1996 Tsai et al. ..... 52/167.3
5,630,298 A * 5/1997 Tsai et al. ..... 52/167.3
5,845,438 A * 12/1998 Haskell ..... 52/167.1
6,405,493 B1 * 6/2002 Taylor ..... 52/167.3
6,722,088 B2 * 4/2004 Ouchi et al. ..... 52/167.3
6,837,010 B2 * 1/2005 Powell et al. ..... 52/167.3
7,174,680 B2 * 2/2007 Smelser ..... 52/167.3
2001/0045069 A1 * 11/2001 Constantinou ..... 52/167.3

(Continued)

FOREIGN PATENT DOCUMENTS

JP 2004-285753 * 10/2004

(Continued)

OTHER PUBLICATIONS

Zahrai, Seyed Mehdi et al., "Ductile End-Diaphragms for Seismic Retrofit of Slab-on-Grader Steel Bridges", Journal Of Structural Engineering, Jan. 1999, pp. 71-80.

(Continued)

*Primary Examiner*—Gary S. Hartmann
(74) *Attorney, Agent, or Firm*—Stein, McEwen & Bui, LLP

(57) ABSTRACT

A girder bridge protection device. The girder protection device includes a sacrifice member having girders installed on an upper surface of a bridge seat of an abutment or pier to support a bridge floor, a symmetrical main support member connecting two of the girders and having an elongated tubular configuration, and an auxiliary support member projecting from one surface of a center portion of the main support member in a direction perpendicular to an axial direction of the main support member; and a restraining member secured to the bridge seat of the abutment or pier and having an accommodating section accommodating the auxiliary support member such that the auxiliary support member is separated from the accommodating section in a forward and rearward direction and in a leftward and rightward direction, thereby controlling the behavior of the auxiliary support member.

22 Claims, 9 Drawing Sheets

U.S. PATENT DOCUMENTS

2002/0129568 A1* 9/2002 Oka ..... 52/167.3

FOREIGN PATENT DOCUMENTS

| | | |
|---|---|---|
| KR | 20-0217048 | 3/2001 |
| KR | 20-0335443 | 12/2003 |
| KR | 2004-97591 | 11/2004 |

OTHER PUBLICATIONS

Akiyama, Hiroshi, "Earthquake-Resistant Limit-State Design for Buildings", University of Tokyo Press, 1985, 14 pages.

Soong, T.T. et al., "Supplemental energy dissipation: state-of-the art and state-of-the-practice", Engineering Structures 2002, pp. 243-259.

Kalyanaraman, V. et al., "Core Loaded Earthquake Resistant Bracing System", 1998 Elsevier Science Ltd., pp. 437-439.

Clark, Peter et al., "Design Procedures for Buildings Incorporating Hysteretic Damping Devices", Proceedings, 68th Annual Convention, Santa Barbara, CA, Structural Engineers Association of CA, Oct. 1999.

Shen, K. L. et al., "Seismic behavior of reinforced concrete frame with added viscoelastic dampers", 1995 Elsevier Science Ltd., pp. 372-380.

Constantinou, M.C. et al., "Experimental Study of Seismic Response of Buildings With Supplemental Fluid Dampers", The Structural Design Of Tall Buildings, vol. 2, 93-132 (1993).

Wada, Akira et al., "Passive damping technology for buildings in Japan", 2000 John Wiley & Sons, Ltd., pp. 335-350.

Pall, Avtar S. et al., "Response Of Friction Damped Braced Frames", Journal of the Structural Division, Jun. 1982, pp. 1313-1323.

Lai, M. L. et al., "Full-Scale Viscoelastically Damped Steel Frame", Journal Of Structural Engineering, Oct. 1995, pp. 1443-1447.

Bruneau, M. et al., "Displacement-based energy dissipation systems for steel bridges diaphragms", Journal Of Constructional Steel Research, 2002, pp. 801-817.

Megally, Sami Hanna et al., "Seismic Response of Sacrificial Shear Keys in Bridge Abutments", Department of Structural Engineering, University of CA, May 2002, 216 pages.

Grigorian, C. E. et al., "Slotted Bolted Connection Energy Dissipators", Earthquake Spectra, vol. 9, No. 3, 1993, pp. 491-504.

Chang, K. C. et al., "Seismic Retrofit of a Reinforced Concrete Frame With Added Viscoelastic Dampers", Earthquake Awareness And Mitigation Across The Nation Proceedings, vol. III, U.S. National Conference On Earthquake Engineering, 1994, 12 pages.

Pall, Avtar S. et al., "Friction-Dampers Used for Seismic Control of New and Existing Buildings in Canada", Technical Papers on Passive Energy Dissipation, pp. 675-686.

* cited by examiner

GIRDER BRIDGE PROTECTION DEVICE USING SACRIFICE MEMBER

BACKGROUND OF THE INVENTION

1. Field of the Invention

The present invention relates, in general, to a device for protecting a bridge, and, more particularly, to an girder bridge protection device using a sacrifice member which functions to support loads normally applied to a bridge and to dissipate energy through plastic behavior caused by sacrificing a symmetrically structured main support member when a seismic load is applied, thereby protecting the remaining main parts of the bridge.

2. Description of the Prior Art

In the present specification, a sacrifice member is a member implementing the concept of a passive energy dissipation device. The member serves as a secondary element which plays a structural role while an earthquake does not occur. When a seismic load is applied, the member plays a role of passively dissipating energy generated in a structure and thereby improving girder performance.

Conventional techniques associated with a passive energy dissipation device or an girder bridge protection device have been disclosed in Korean Utility Model Registration No. 217048 (dated Jan. 5, 2001) entitled "Apparatus for preventing separation of super structure from continuous steel box bridge" and Korean Utility Model Registration No. 335443 (dated Nov. 28, 2003) entitled "Apparatus for supporting bridge".

In the conventional art, various structures have been applied as the passive energy dissipation device. Examples of the typical devices developed so far include metallic yield dampers, friction dampers, viscoelastic dampers, viscous fluid dampers, tuned mass dampers, tuned liquid dampers, etc. (Soong et al., 2002).

The metallic yield dampers function to dissipate energy generated in a structure by a seismic load, using a nonlinear behavior characteristic of a metal. Devices which are generally used adopt an ADAS (added damping and stiffness) method in which an X-shaped or triangular steel plate is used so as to evenly distribute plastic deformation over the entire member. Other devices have a honeycomb-shaped configuration which is mainly adopted in Japan, employ shear panels, and are formed of lead, shape-memory alloy, etc. which are different from steel (Aiken et al., 1992).

Recently, in another type of metallic yield damper, an unbonded brace (tension/compression yielding brace) is used. The unbonded brace is composed of a steel section for dissipating energy by axial force and a tube filled with concrete to resist buckling due to compressive force (Wada, 1999; Clark, 1999; and Kalyanaraman et al., 1998).

The friction dampers serve as devices which dissipate energy generated in structures by seismic loads using frictional force generated between two objects. That is to say, the friction dampers dissipate energy using frictional force generated in the device by compressive and tensile force.

A hysteresis loop of the friction damper reaches a square due to the characteristic of coulomb friction. Using this hysteresis model, it is possible to analyze the behavior of the structure due to a seismic load (Pall et al., 1982; Gringorian et al., 1993; and Pall et al., 1993).

The viscoelastic dampers function to dissipate energy generated in a structure mainly using shearing deformation of copolymer, a glass material, etc. (Chang et al., 1994; Shen et al., 1995; and Lai et al., 1995).

The viscous fluid devices are largely divided into viscous walls and VF dampers. The viscous walls are devices in which energy is dissipated while a plate is moved between thin steel plates filled with viscous liquid. The viscous walls have been used for military and aviation purposes and recently have been applied to civil-engineered structures.

The VF dampers comprise a piston which is defined with an orifice and which moves in a cylinder filled with highly viscous material such as silicon and oil (Constantinou et al., 1993). The VF dampers function to dissipate energy generated by a seismic load, through the movement of the piston which is caused due to the operating principle of the orifice. There are frequent occasions in which the VF damper is used along with an girder isolation base.

The tuned mass dampers and the tuned liquid dampers use specified masses or liquids to decrease the sizes of responses under specified modes. In these dampers, since it is possible to increase the sizes of responses under other modes, they are applied to active mass dampers which are a kind of active control system, rather than a passive control system.

Except for the VF dampers, each of which is used along with the girder isolation base, the devices for improving girder performance as described above are limitedly used in bridge structures and have mainly been developed so as to be used for constructional structures (Zahrai et al., 1999).

Meanwhile, recently, efforts have been made to develop a sacrifice member which performs a predetermined structural function to serve as a secondary member while an earthquake does not occur and which passively dissipates energy generated in a structure to improve girder performance when a seismic load is applied.

For example, shear keys and ductile bracings which are installed on ends of a bridge are formed by introducing the concept of the sacrifice member to a seismic load.

The shear keys are devices which function to support horizontal force generated in a direction perpendicular to a bridge axis (a bridge extending direction). The shear keys cause a seismic load to be concentrated in the shear keys which are installed on abutments when an earthquake occurs, and thereby prevent abutments and piers from being damaged. In the shear keys, seismic responses and analyses thereof, and design techniques have been researched through an SSRP (structural systems research project) (Megally et al., 2001).

The shear keys are divided depending upon their shapes into internal shear keys which are installed inside the abutments below a super structure and external shear keys which are installed at sides of the super structure.

In the case of the internal shear keys, while advantages are provided in that it is possible to resist seismic behavior both in the direction of the bridge axis and in the direction perpendicular to the bridge axis, disadvantages are also provided in that it is not easy to gain access to the internal shear keys after installation.

In the case of the external shear keys, while advantages are provided in that it is easy to gain access to the external shear keys, disadvantages are provided in that it is impossible to resist seismic behavior in the direction of the bridge axis.

The devices for improving girder performance of a bridge by using the ductile bracings installed on the ends of the bridge as a sacrifice member are constituted by applying EBFs (eccentrically braced frames), SPSs (shear panel systems), or TADASs (triangular plate added damping and stiffness devices), a kind of ADAS, to the vertical end bracings of steel plate girder bridges. These devices function to dissipate energy generated due to a seismic load applied to a sub structure of the bridge in the direction perpendicular to the bridge axis.

The ductile bracings are designed to be plastically deformed before the sub structure of the bridge reaches a yield point, so that damage due to a seismic load which may be caused in a non-ductile member or a bridge base and bridge seat section can be prevented.

However, these devices are applied on the assumption that the deformation or load generated in the direction of the bridge axis is restrained in some way, and therefore, suffer from defects in that they are incapable of dissipating energy and preventing displacement generated in the direction of the bridge axis due to a seismic load (Zahrai et al., 1999; and Bruneau et al., 2002).

As a result, the conventional girder bridge protection devices as mentioned above encounter problems as described below.

First, it is difficult to apply the conventional girder bridge protection devices to existing bridges and newly constructed bridges, traffic control is necessary to construct the conventional girder bridge protection devices, and it is essential to use costly equipment which is specially fabricated, whereby the economic burden increases.

Second, since the conventional girder bridge protection devices do not normally play a specific role with regard to the behavior of a bridge, if an earthquake does not occur throughout the lifetime of the bridge, the conventional girder bridge protection devices cannot perform any function, whereby economic loss is caused.

Third, it is impossible for the conventional girder bridge protection devices to resist a seismic load in all directions including the direction of the bridge axis and the direction perpendicular to the bridge axis.

Fourth, since it is impossible to precisely predict elastic and plastic behavior of a sacrifice member, it is difficult to secure structural stability.

Fifth, maintenance and repair work cannot be easily implemented for the conventional girder bridge protection devices. Further, when the sacrifice member is damaged, it is not easy to replace the damaged sacrifice member with new one.

In order to cope with these problems, Sang Hyo KIM, the inventor of the present application, has disclosed Korean Patent Laid-open Publication No. 2004-97591 (dated Nov. 18, 2004) entitled "Girder bridge protection apparatus, sacrifice bracing, sacrifice bracing restrainer composing it and reinforcement construction method thereof".

In the sacrifice bracing described in the published patent document, a central stress concentration section which has a reduced cross-sectional area due to the presence of a notch prevents a shock, generated upon the occurrence of an earthquake, from being transferred to other main parts of the bridge.

In the sacrifice bracing suggested in the published patent document, due to an asymmetrical configuration, it is possible to properly resist vibration which has a level no less than a yield point and basically acts in a direction corresponding to the direction of a bridge axis when an earthquake occurs. Nevertheless, the sacrifice bracing cannot properly resist a seismic shock which acts in the direction perpendicular to the bridge axis.

SUMMARY OF THE INVENTION

Accordingly, the present invention has been made to solve the above problems occurring in the prior art and to protect a bridge from a seismic load and various normally applied external forces.

In particular, an object of the present invention is to advantageously modify the subject matters of Korean Patent Laid-open Publication No. 2004-97591 and provide an girder bridge protection device using a sacrifice member which includes a symmetrical main support member playing a role of improving the structural behavior of main parts while an earthquake does not occur and of effectively dissipating energy generated by a seismic load when an earthquake occurs.

In order to achieve the above object, according to the present invention, there is provided an girder bridge protection device comprising a sacrifice member including girders which are installed on an upper surface of a bridge seat of an abutment or pier to support a bridge floor, a symmetrical main support member which connects two girders and has a pipe-shaped configuration, and an auxiliary support member which projects from one surface of a center portion of the main support member in a direction perpendicular to an axial direction of the main support member; and a restraining member secured to the bridge seat of the abutment or pier and including an accommodating section which accommodates the auxiliary support member such that the auxiliary support member is separated from the accommodating section in a forward and rearward direction and in a leftward and rightward direction, thereby controlling behavior of the auxiliary support member.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1A:
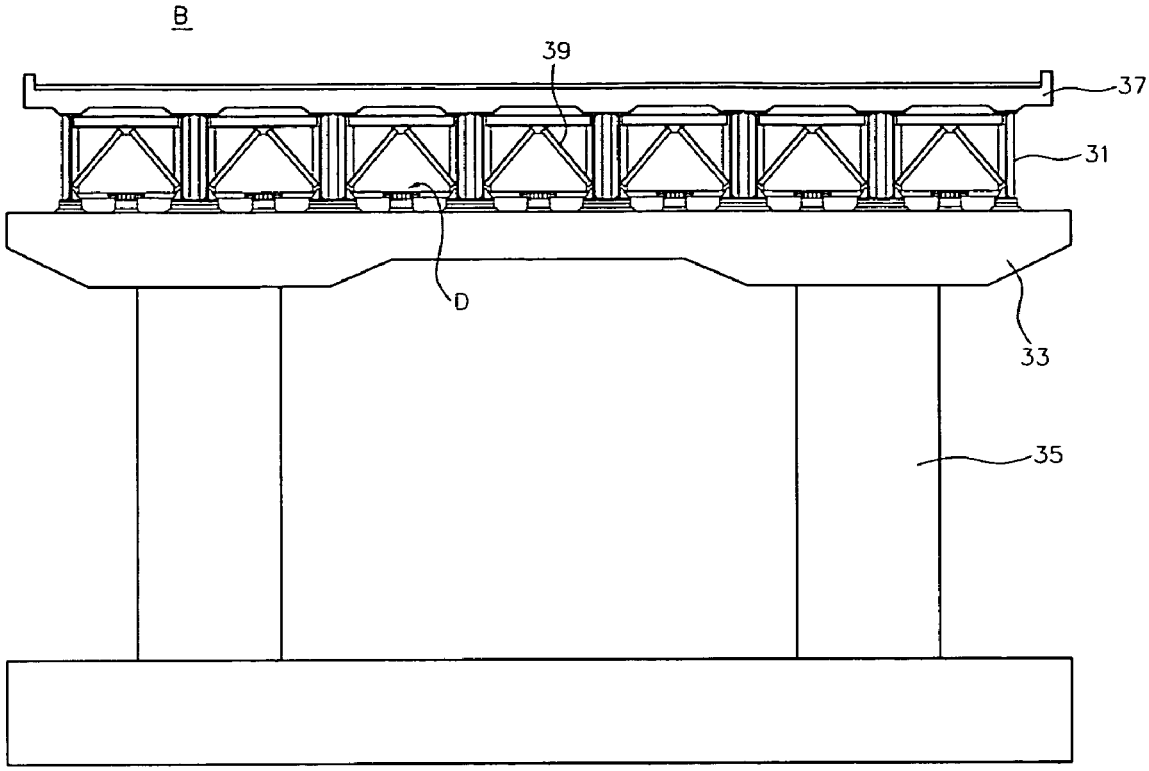
FIG. 1*a* is a front view illustrating a bridge which adopts an I-shaped plate girder using an girder bridge protection device according to the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

In the drawings, the same reference numerals, in particular the reference numerals having the same first and second figures or the same first and second figures and the same reference letters designate members having the same function. In this regard, it is to be noted that the component parts indicated by respective reference numerals conform to this rule unless specifically mentioned.

In explaining an girder bridge protection device D according to the present invention, directions are set as follows with reference to FIGS. 1*a* and 1*b*. A lengthwise direction of a super structure which connects piers positioned at both ends of a bridge B, that is, the direction of a bridge axis, is set as a forward and rearward direction. Further, a lengthwise direction of a main support member 11, which constitutes a sacrifice member 10 of the girder bridge protection device D according to the present invention and connects I-shaped plate girders 31 or box-shaped girders 131 (see FIG. 1*c*) for supporting a bridge floor 37, is set as a leftward and rightward direction, and a gravity direction is set as an upward and downward direction.

Figure 1B:
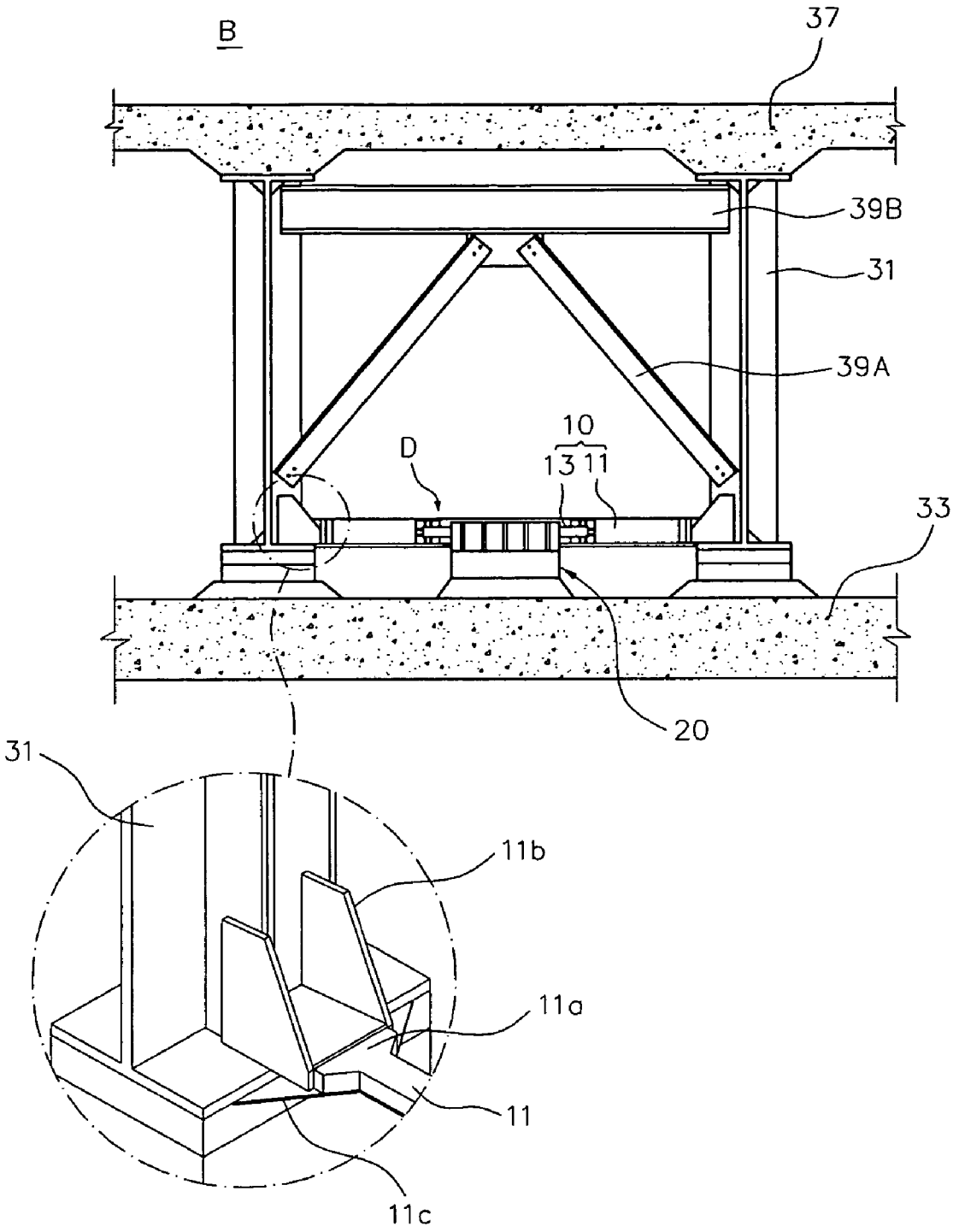
FIG. 1*b* is a partially enlarged partial cross-sectional view illustrating the bridge which adopts the I-shaped plate girder.

Referring to FIGS. 1*a* and 1*b*, the sacrifice member 10 of the girder bridge protection device D according to the present invention includes girders 31 which are installed on the upper surface of the bridge seat 33 of an abutment (not shown) or pier 35 to support a bridge floor 37, a symmetrical main support member 11 which connects two girders 31 and has a pipe-shaped configuration, and an auxiliary support member 13 which projects from one surface of the center portion of the main support member 11 in a direction perpendicular to the axis of the main support member 11.

While the sectional area of the auxiliary support member 13 may correspond to 30-95% of the main support member 11, in order to ensure easy prediction of energy dissipation degree and functionality of the sacrifice member, it is preferred that the sectional area of the auxiliary support member 13 approach as closely as possible to that of the main support member 11.

When compared to the sacrifice member described in Korean Patent Laid-open Publication No. 2004-97591 which comprises a pair of L-shaped steel elements, the sacrifice member according to the present invention can be conveniently manufactured and simply installed since the sacrifice member can be easily coupled at the proper positions to the girders.

In the sacrifice member described in Korean Patent Laid-open Publication No. 2004-97591, because the pair of steel elements behave independently of each other, structural analysis is complicated. However, in the present invention, since it is sufficient to implement structural analysis only for the single main support member, convenience is rendered.

Further, the sacrifice member according to the present invention can perform required functions while an earthquake does not occur and when an earthquake occurs, without the need of providing a stress concentrating portion in the form of a notch as disclosed in Korean Patent Laid-open Publication No. 2004-97591.

In the present invention, the main support member 11 of the sacrifice member is installed to define a configuration which connects the lower ends of two adjoining girders to satisfy a transverse support condition of a structure. Normally, the main support member 11 serves as a secondary element which functions to help a bridge maintain its sectional shape and secure its sufficient strength and to ensure reliable transmission of a transverse load to the bridge seat.

Figure 1C:
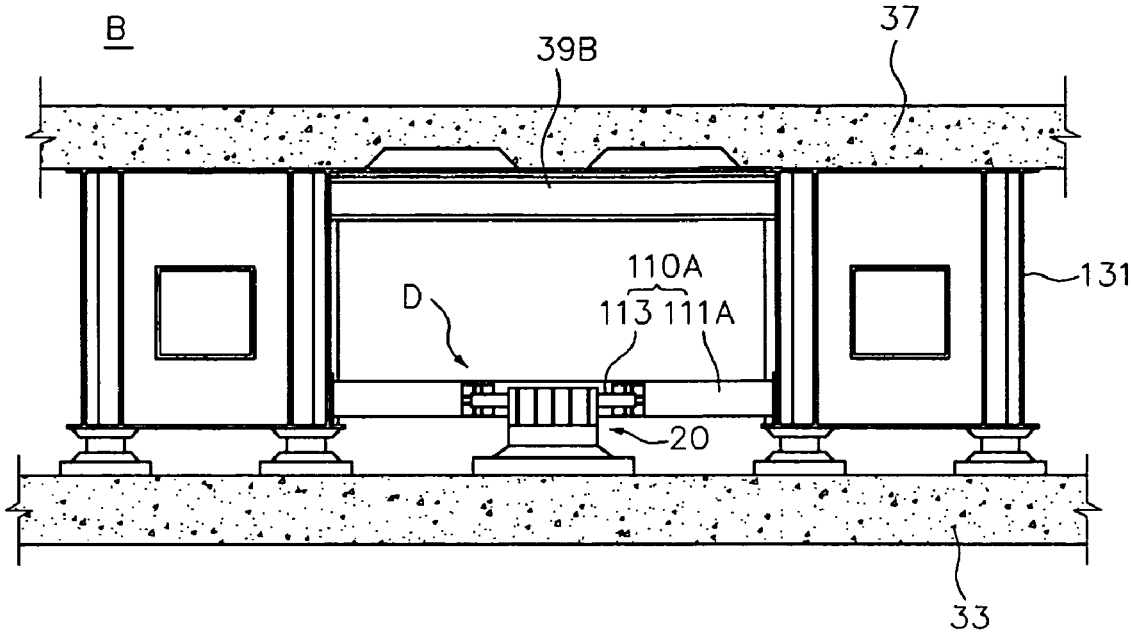
FIG. 1*c* is a partial cross-sectional view illustrating a bridge which adopts a box-shaped girder.

The girders of a bridge to which the girder bridge protection device D according to the present invention is applied may comprise the I-shaped plate girders 31 as shown in FIGS. 1*a* and 1*b*, the box-shaped girders 131 as shown in FIG. 1*c*, and the likes.

It is preferred that the sacrifice member 10 be manufactured to have strength less than that of the girders 31, and other reinforcing braces 39A or a transverse end beam 39B (see FIG. 1*b*).

Figure 2A:
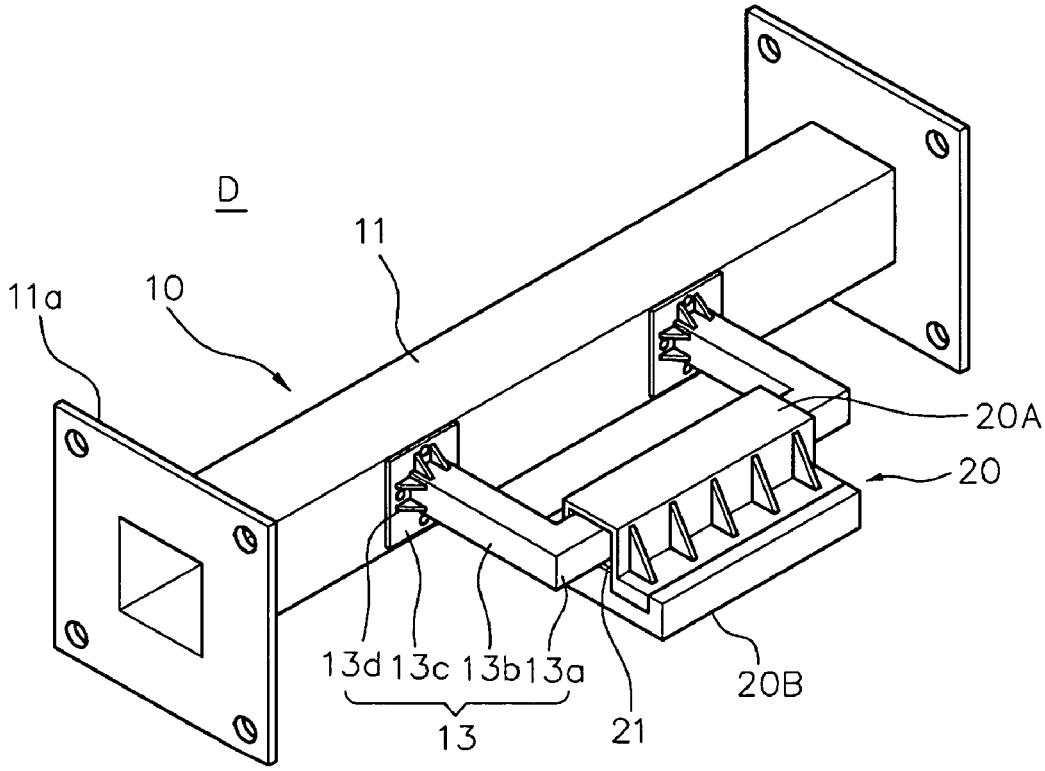
FIGS. 2*a* through 2*c* are a perspective view and plan views illustrating in detail the sacrifice member shown in FIG. 1*b;*
Figure 3A:
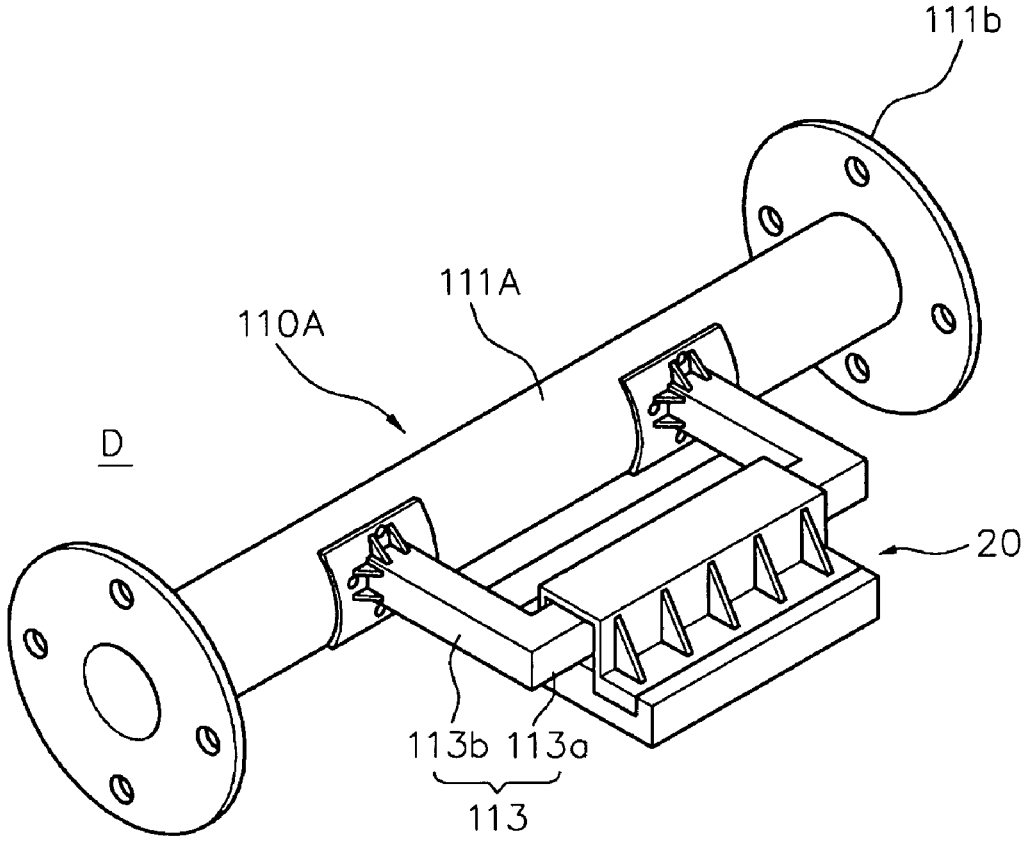
FIG. 3*a* is a perspective view illustrating in detail the sacrifice member shown in FIG. 1*c;*

The main support member of the sacrifice member may comprise a symmetrical pipe which has a quadrangular sectional shape, in particular, a square sectional shape as shown in FIGS. 1*b* and 2*a*, or a circular sectional shape as shown in FIGS. 1*c* and 3*a*.

While the main support member may have various sectional shapes, in order to ensure easy coupling of the auxiliary support member to the main support member, it is preferred that the main support member has a quadrangular sectional shape.

Referring to FIG. 1*b*, in the sacrifice member 10 of the girder bridge protection device D which is installed on the I-shaped plate girders 31, both ends of the main support member 11, through which the main support member 11 is connected to the girders 31, have larger sectional areas than the other portions of the main support member 11. When connecting the main support member 11 to the girders 31, separate plates 11*b* and 11*c* are provided on the sides and the lower surface of each end of the main support member 11 and then welded thereto.

The girder bridge protection devices D shown from FIG. 2*a* to the end of the drawings are mainly used in a bridge B which adopts the box-shaped girders 131 as shown in FIG. 1*c*. In this type bridge having the box-shaped girders, since the size of the transverse end beam 39B is decreased due to the presence of the girder bridge protection devices D according to the present invention when compared to that of a conventional bridge of the same kind, a bridge construction cost can be reduced and construction work can be easily implemented.

In FIG. 2*a*, both ends of the main support member 11 are formed with flanges 11*a* so that the main support member 11 can be easily coupled to the box-shaped girders through welding, riveting, bolting, etc. Similarly, flanges are formed at both ends of each of the main support members of various sacrifice members shown from FIG. 2*a* to the end of the drawings to ensure easy coupling of the main support member to the girders. In these drawings, the flanges are formed to be bolted to the girders.

With regard to the flanges 11*a* serving as a connection member for connecting the girders and the sacrifice member 10, in particular, the main support member, it is preferred that a connection type of the flanges be determined in consideration of a designed seismic load of a geographical area where the bridge is to be installed so that an amount of load which is supported by the girders can be minimized to prevent damage to the girders.

That is to say, in a medium-sized or slight earthquake region, since the deformation of the main support member of the sacrifice member is not substantial, various reinforcing members can be separately placed to the side surfaces of the girders.

However, in the case of a severe earthquake region, since the deformation of the sacrifice member is substantial, vertical reinforcing members can be placed on the side surface of the girders and both ends of the main support member can be simultaneously coupled to the vertical reinforcing members and to the lower flanges of the girders.

By this fact, when an earthquake occurs, only the sacrifice member made of a material which has less strength than the girders is plastically deformed, and the girders only undergo elastic deformation.

Referring to FIGS. 1*a*, 1*b*, and 2*a*, restraining member 20 which constitutes the girder bridge protection device D according to the present invention is secured to the bridge seat 33 of the abutment or pier. The restraining member 20 includes an accommodating section 21 which accommodates the auxiliary support member 13 of the sacrifice member 10 and 110 such that the auxiliary support member 13 is separated from the accommodating section 21 by a predetermined distance to control the behavior of the auxiliary support member 13.

The auxiliary support member 13 projects in one direction which is perpendicular to the axis of the main support members 11 and 111, in particular, in a forward direction. The auxiliary support member 13 is coupled to the main support member 11 and 111 in such a way as to define a closed loop.

The auxiliary support member 13 has a substantially U-like sectional shape. The auxiliary support member 13 includes a pair of connection sections 13*b* which are connected to the main support member 11 and 111 and an accommodated section 13*a* which connects the pair of connection sections 13*b* with each other and is positioned in the accommodating section 21 of the restraining member 20.

The accommodating section 21 of the restraining member 20 has a sectional shape which is the same as or different from that of the auxiliary support member 13 of the sacrifice member 10 and 110.

However, in order to reliably restrain the behavior of the sacrifice member 10 and 110 by the restraining member 20 when an earthquake occurs, it is preferred that the accommodating section 21 of the restraining member 20 have the same sectional shape as the auxiliary support member 13. In the drawings, the auxiliary support member 13 and the accommodating section 21 of the restraining member 20 have quadrangular sectional shapes.

Here, the distance between the accommodating section 21 and the auxiliary support member 13 of the sacrifice member 10 and 110 is determined in consideration of the predicted displacement of the sacrifice member 10 and 110 which is caused by temperature change, sagging, concrete creep, dry contraction, and elastic deformation of the members due to pre-stress, of the super structure of the bridge.

In other words, since the sacrifice member 10 and 110 must serve as the secondary reinforcing element while an earthquake does not occur, it is not preferable, in view of the protection of the bridge, for the auxiliary support member or the main support member of the sacrifice member 10 and 110 to be restrained by the restraining member 20 and undergo plastic deformation while a normal load is applied. Therefore, it is effective that a predetermined distance is defined between the accommodating section of the restraining member and the auxiliary support member of the sacrifice member.

However, if the separation distance is excessively large, the sacrifice member 10 and 110 may not undergo plastic deformation even under the action of the restraining member 20 when an earthquake occurs. Thus, it is preferred that the separation distance be determined not to exceed the displacement of the sacrifice member 10 which is predicted under application of a normal load less than a seismic load.

The relative displacement of the auxiliary support member 13 of the sacrifice member 110 which is restrained by the accommodating section 21 of the restraining member 20 corresponds to the distance d1 between the inner wall of the accommodating section 21 and the outer wall of the accommodated section 13*a*, through which the auxiliary support member 13 can be moved in the forward and rearward direction.

While the distance d1 may vary at every position depending upon the configuration and the sectional area of the accommodating section and the accommodated section, in order to ensure predictability, it is preferred that the distance d1 be kept constant at any positions on the accommodating section and the accommodated section.

The auxiliary support member has a leftward and rightward relative displacement which corresponds to the distance d2 between the left or right end of the accommodating section 21 of the restraining member 20 and the connection section 13*b* of the auxiliary support member 13.

The distances d1 and d2 are determined through structural analysis and may have various values.

In the above description, the upward and downward separation between the auxiliary support member of the sacrifice member and the restraining member is not considered. The reason to this is that the requirement for dealing with upward and downward vibration is insignificant when compared to the requirement for dealing with forward and rearward vibration and the leftward and rightward vibration, in the light of girder design characteristics of a bridge. However, as the case may be, necessary measures can be taken to deal with the upward and downward vibration.

Figure 2B:
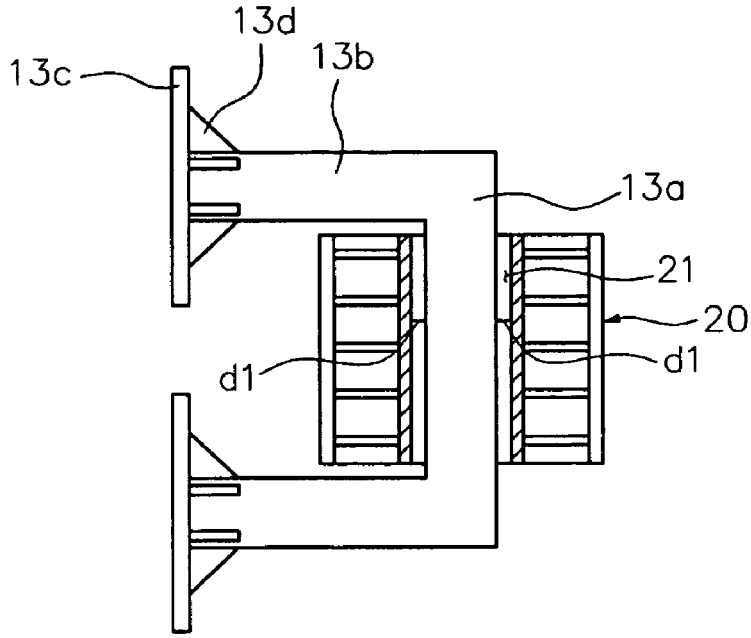
Figure 2C:
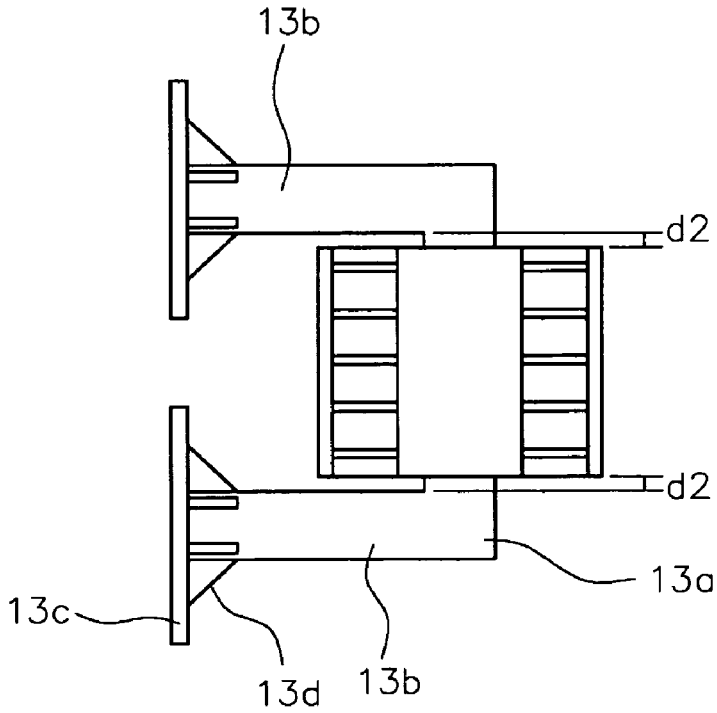
Figure 2D:
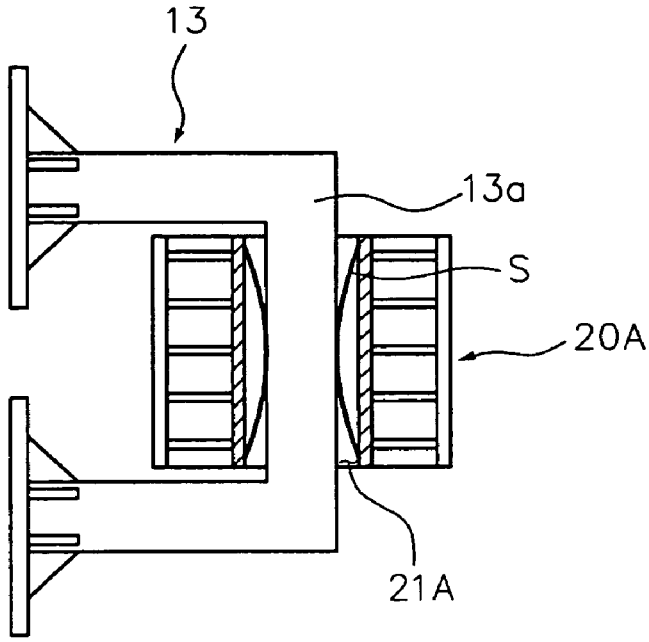
FIG. 2*d* is a cross-sectional view illustrating a variation of FIG. 2*a* which adopts a leaf spring.

Meanwhile, referring to FIG. 2*d*, an elastic member, specifically, a leaf spring S is intervened between the accommodating section 21A of the restraining member 20A and the accommodated section 13*a* of the auxiliary support member 13. The leaf spring S prevents the auxiliary support member 13 or the restraining member 20 from being broken by a shock generated due to vibration suddenly applied in the forward and rearward direction, and the girder bridge protection device D according to the present invention from losing its functionality. The leaf spring S can be applied to other types of sacrifice members.

The elastic member may have various shapes.

In FIG. 2*a*, in order to ensure easy installation of the restraining member 20, it is preferred that the restraining member 20 comprise an upper body 20A which is formed with the accommodating section 21 for accommodating the auxiliary support member 13 and a lower body 20B which is secured to the bridge seat 33, the upper body 20A and the lower body 20B being assembled with each other.

Due to the fact that the auxiliary support member 13 of the sacrifice member 110 is positioned in the accommodation section 21 of the restraining member 20, leftward, rightward, forward and rearward behavior of the sacrifice member is restrained.

As a consequence, in the case that the relative behavior of the super and sub structures of the bridge increases through application of large external force reaching a seismic load, the sacrifice member 110 undergoes bending behavior under the action of the restraining member 20. This means that the sacrifice member 110 goes out of an elastic deformation range and undergoes plastic behavior. Therefore, through repetition of this hysteresis behavior, it is possible to dissipate the energy applied to the bridge by a seismic load.

In the girder bridge protection device according to the present invention, the sacrifice member 110 serving as a kind of brace adopts a structure in which the lower ends of two adjoining girders are connected with each other. Thus, the girder bridge protection device according to the present invention can be applied to any kinds of bridges so long as the bridges are configured in a manner such that the super and sub structures of each bridge are connected by the girders. Namely, the present invention can be applied to I-shaped plate girder bridges and box-shaped girder bridges. Also, so long as a bridge has the structure of a girder bridge, the present invention can be applied to all of simple beam bridges, continuous bridges, steel bridges and concrete bridges.

In the present invention, the sacrifice member not only performs a function of a sacrifice member for dissipating a seismic load through hysteresis behavior, but also serves as a secondary reinforcing element to be used under a normal load. While the sacrifice member is required to have strength which is greater than predetermined strength, if the sacrifice member has excessively large strength, the girders connected to both ends of the sacrifice member are likely to be damaged. In this consideration, it is preferred that the sacrifice member be made of a material having strength less than the girders and/or other reinforcing braces.

In the girder bridge protection device D according to the present invention, the material and the sectional shape of the sacrifice member must be designed in consideration of the characteristics of a geographical area where the bridge is to be installed.

For example, in a medium-sized and slight earthquake region such as Korea, it is preferable to install the sacrifice member so that the function of the sacrifice member as a secondary reinforcing element is emphasized. In the case of a severe earthquake region such as Japan, it is preferable to install the sacrifice member so that the original function of the sacrifice member is emphasized.

The sacrifice member according to the present invention, more particularly, the auxiliary support member which projects in the direction perpendicular to the axis of the main support member, can have a variety of configurations.

For example, as can be readily seen from FIGS. 2*a*, and 3*a* through 3*e*, the sacrifice members are divided into a first type in which the main support member and the auxiliary support member are coupled to each other to define a closed loop, and a second type in which the sacrifice member comprises a bar-shaped configuration.

In these respective drawings, while the auxiliary support members are shown as having a quadrangular sectional shape, it is to be readily understood that the auxiliary support member may have a variety of sectional shapes. Also, it is to be noted that the sectional area of the auxiliary support member may vary, and, as the case may be, may be the same as or exceed the sectional area of the main support member.

Due to the fact that the accommodating section of the restraining member has a sectional shape which corresponds to that of the auxiliary support member, it is possible to reliably restrain the behavior of the sacrifice member by the restraining member.

In this way, the restraining member not only can restrain the behavior of the sacrifice member in the direction of a bridge axis (the forward and rearward direction) to cause plastic breakage of the center portion of the main support member serving as a stress concentrating section, but also can simultaneously restrain the behavior of the sacrifice member in the direction perpendicular to the bridge axis (the leftward and rightward direction) to perform a function of a restrainer.

The auxiliary support member and the main support member can be connected with each other through welding, riveting, bolting, etc. In the drawings, the flanges 13*c* (see FIG. 2*a*) of the auxiliary support member are bolted to the main support member. A plurality of reinforcing ribs 13*d* is formed between the flange 13*c* and the connection section 13*b*.

As described above, the auxiliary support member 13 as shown in FIGS. 1*a*, 1*b* and 2*a*, which has the configuration defining the closed loop, projects in the direction perpendicular to the axis of the main support member, particularly, in the forward direction, and has a substantially U-like sectional shape.

In the auxiliary support member defining the closed loop, the accommodated section 13*a* may not be continuous but be snapped at the middle portion thereof. Of course, in the latter case, the auxiliary support member does not define a closed loop.

In the sacrifice member 110A shown in FIGS. 1*c* and 3*a*, as described above, the main support member 111A and the flanges 111*b* formed at both ends of the main support member 111A have circular sectional shapes. The auxiliary support member 113, which projects in the direction perpendicular to the axis of the main support member 111, particularly, in the forward direction, comprises the connection sections 113*b* and the accommodated section 113*a*.

Figure 3B:
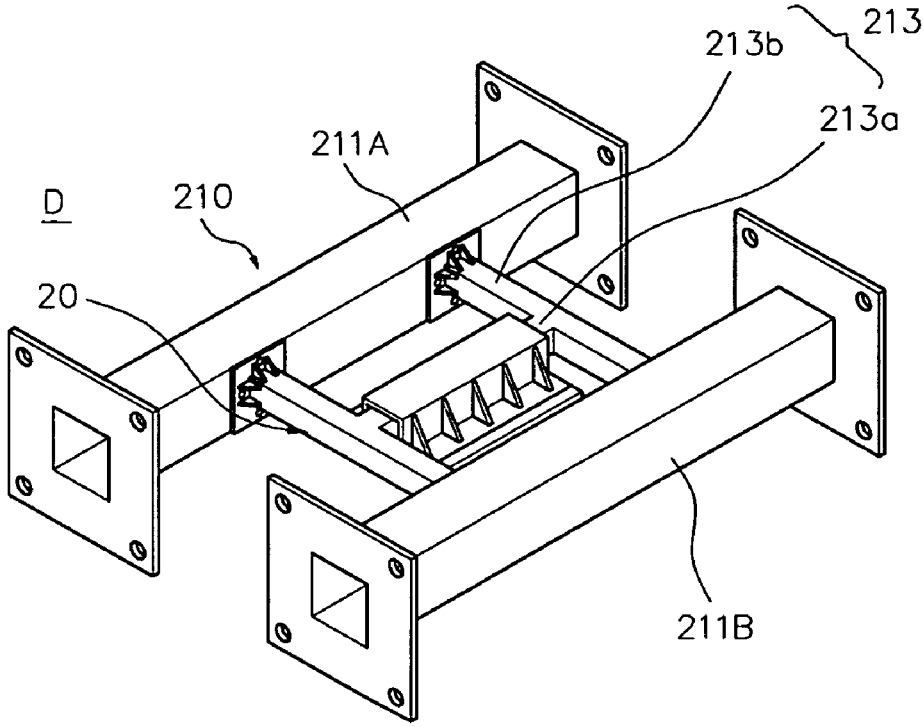
FIGS. 3*b* through 3*e* are perspective views illustrating different shapes of bridge protection devices.

Sacrifice member 210 shown in FIG. 3*b* comprises a pair of main support members 211A and 211B which are installed on the same bridge seat and respectively connect two pairs of girders separated from each other.

Specifically, between facing surfaces of the pair of main support members, there is provided an auxiliary support member 213. The auxiliary support member 213 comprises a pair of connection sections 213*b* each of which connects the main support members with each other and an accommodated section 213*a* which connects the middle portion of the connection sections 213*b* with each other. In this sacrifice member, the two main support members share the one auxiliary support member.

Since the accommodated section 213*a* of the auxiliary support member 213 has the same shape as the accommodated section 13*a* shown in FIG. 2*a*, the same restraining member 20 can be used in this sacrifice member.

Figure 3C:
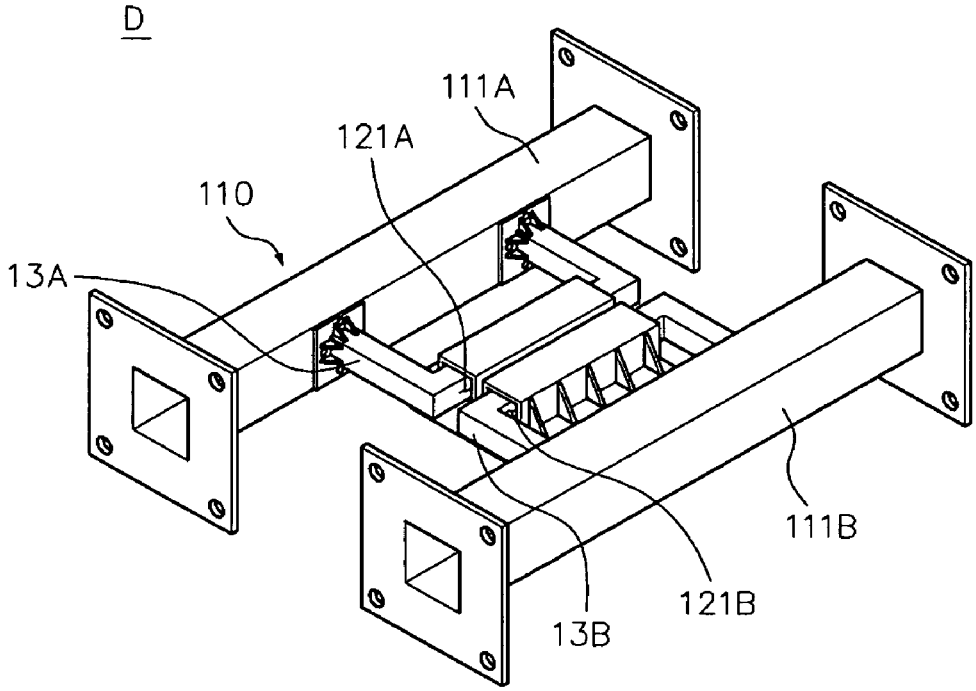

FIG. 3*c* illustrates a variation of FIG. 3*b*, in which auxiliary support members for two sacrifice members are accommodated in one restraining member.

In the illustrated sacrifice member 110, the auxiliary support members 13A and 13B are formed on the facing surfaces of main support members 111A and 111B which respectively connect two pairs of girders separated from each other. Two accommodating sections 121A and 121B are formed in the restraining member 120 to receive the two auxiliary support members 13A and 13B, respectively.

Figure 3D:
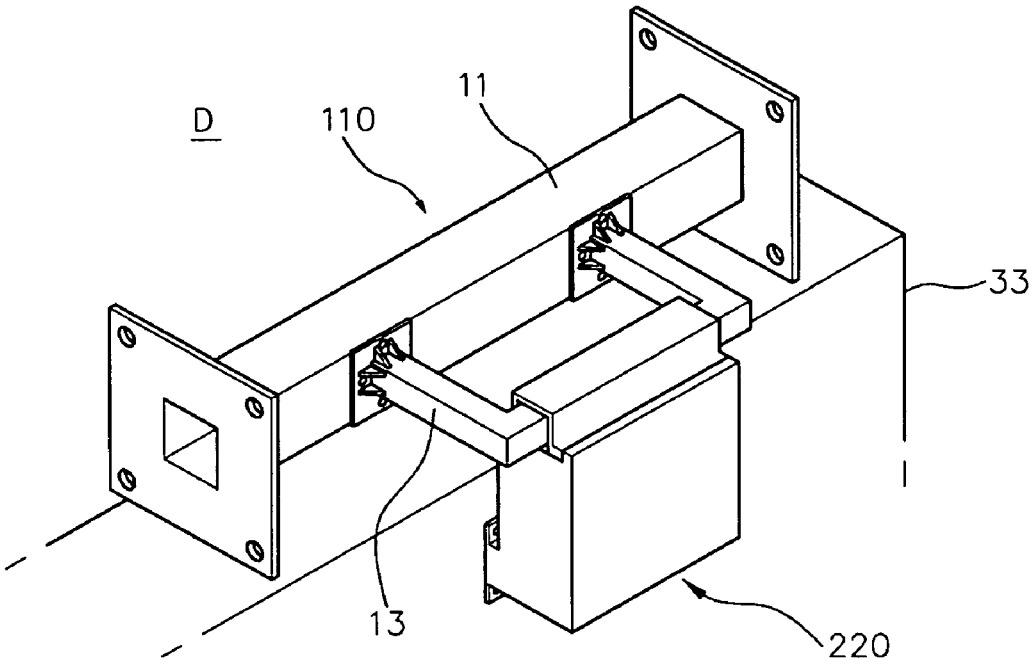

In the girder bridge protection device D according to the present invention as shown in FIG. 3*d*, sacrifice member 10 has restraining member 220 which is installed on the side surface of the bridge seat 33 of an abutment or pier. This restraining member 220 can be used when the girder bridge protection device according to the present invention is installed to repair an already constructed bridge or when an area of the bridge seat is insufficient.

Figure 3E:
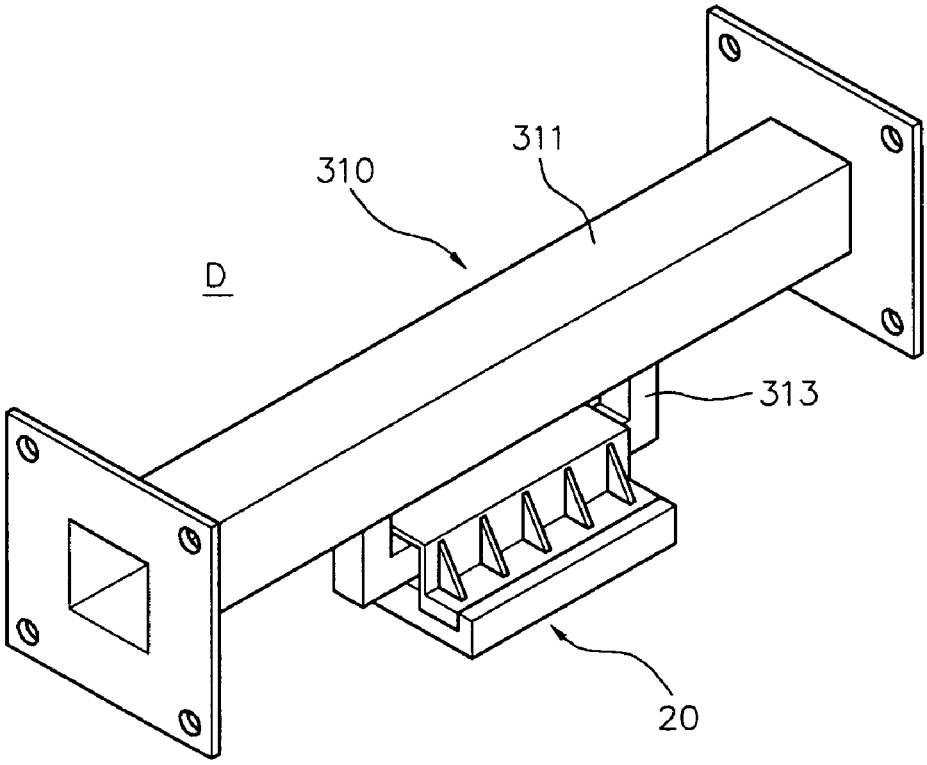

In the sacrifice member 310 shown in FIG. 3*e*, an auxiliary support member 131 comprises connection sections and an accommodated section which project downward from a main support member 311.

Figure 4A:
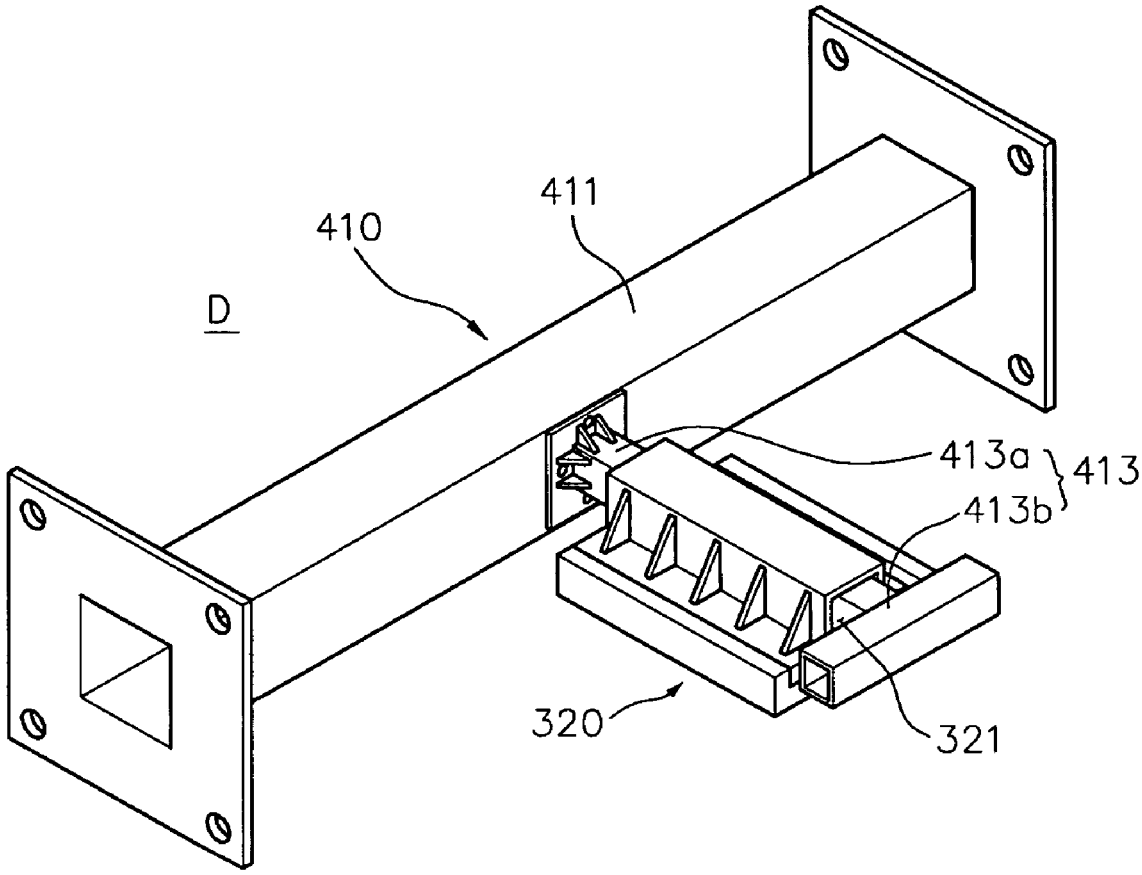
FIGS. 4*a* through 4*c* are a perspective view and plan view illustrating a sacrifice member having a bar-shaped auxiliary support member.

Next, as a bar-shaped auxiliary support member, an auxiliary support member 413 of sacrifice member 410 shown in FIG. 4*a* comprises a bar-shaped accommodated section 413*a* which projects in the direction perpendicular to the axis of a main support member 411, particularly, in the forward direction, and a release prevention section 413*b* which is coupled to an end of the accommodated section 413*a*, more concretely, in a direction perpendicular to the axis of the accommodated section 413*a*.

An accommodating section 321 of restraining member 320 is formed to extend in the forward and rearward direction to accommodate the accommodated section 413*a* of the auxiliary support member 413.

The behavior of the sacrifice member 410 shown in FIG. 4*a* is restrained by the release prevention section 413*b* of the auxiliary support member and the restraining member 320.

As described above with reference to FIGS. 2*a* through 2*c*, in FIG. 4*a*, in order to prevent plastic deformation of the bridge, it is preferred that the auxiliary support member 413 and the accommodating section 321 of the restraining member 320 be separated by a predetermined distance.

Figure 4B:
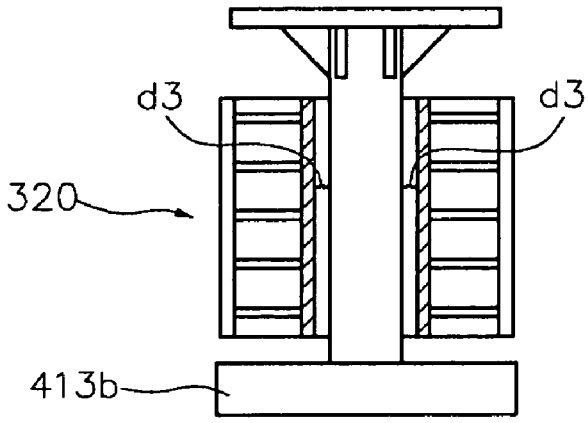

Therefore, as shown in FIG. 4*b*, the relative displacement between the auxiliary support member 413 of the sacrifice member 410 which is restrained by the accommodating section 321 of the restraining member 320 and the restraining member 320 corresponds to a distance d3 between the inner wall of the accommodating section 321 and the outer wall of the accommodated section 413*a*, through which the auxiliary support member 13 can be moved in the leftward and rightward direction.

While the distance d3 may also vary at every position depending on the configuration and the sectional area of the accommodating section and the accommodated section, in order to ensure predictability, it is preferred that the distance d3 be kept constant on any position on the accommodating section and the accommodated section.

Figure 4C:
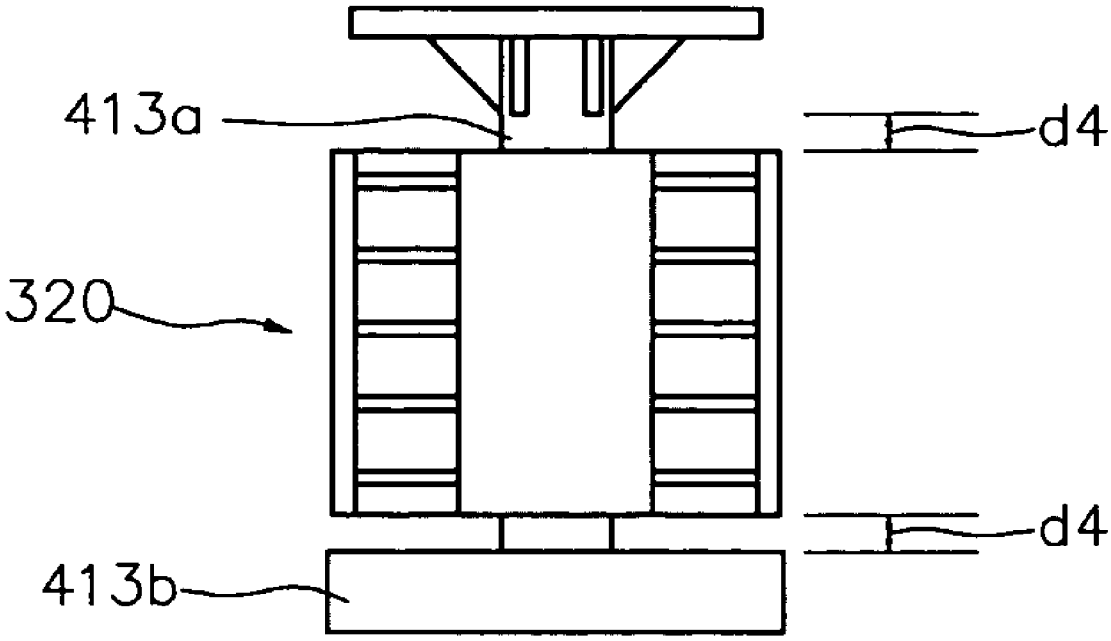

Also, referring to FIG. 4*c*, the auxiliary support member 413 has a forward and rearward relative displacement which corresponds to the distance d4 between the front or rear end of the accommodating section 321 of the restraining member 320 and the release prevention section 413*b* of the auxiliary support member 413 or the front wall of the main support member 411 (or the flange of the auxiliary support member 413).

The distances d3 and d4 are determined through structural analysis and may have various values.

When installing the girder bridge protection device according to the present invention, the strength, shape and size of the sacrifice member are determined through structural analysis conducted in consideration of the characteristics of a geographical area where the bridge is to be installed. Further, displacement of the sacrifice member due to elastic deformation of the members caused by temperature change, sagging, concrete creep, dry contraction and pre-stress of the super structure of the bridge, and due to a seismic load, is predicted.

Also, a separation distance between the accommodating section of the restraining member and the auxiliary support member of the sacrifice member is determined to correspond to the displacement of the sacrifice member. The restraining member (particularly, the lower body) is secured at a proper position on the bridge seat on which the girders are installed, and then, the restraining member and the auxiliary support member of the sacrifice member are coupled to each other.

The girder bridge protection device D according to the present invention may be installed only on bridge seats which have movable ends, or on all bridge seats, whether they have movable ends or fixed ends. Further, after the bridge seats are formed so that they have movable ends, the girder bridge protection device D according to the present invention may be installed on all bridge seats.

Concretely speaking, the girder bridge protection device D according to the present invention can be installed on bridge seats which have the movable ends, among all bridge seats, and this option is most appropriate when installing the girder bridge protection device D on the existing bridges.

Moreover, the girder bridge protection device D according to the present invention can be installed on all bridge seats which have movable ends or fixed ends, and this option is most appropriate when the shear fracture of bridge seats having fixed ends is likely to occur due to excessive inertia force of the super structure of the bridge.

If an earthquake occurs, the girder bridge protection devices installed on the bridge seats having movable ends first yield to a seismic load due to the difference in distance between the super and sub structures of the bridge. Then, as the seismic load increases, the girder bridge protection devices installed on the bridge seats having the fixed ends yield to the seismic load. In this regard, since the girder bridge protection devices according to the present invention can prevent brittle fracture through plastic deformation of the sacrifice member, as a result of which it is possible to prevent collapse of the bridge due to abrupt breakage of the bridge seats having the fixed ends.

Finally, the bridge seats can be formed to have movable ends, and then, the girder bridge protection devices D according to the present invention can be installed on all bridge seats.

As is apparent from the above description, the girder bridge protection device according to the present invention provides advantages in that it is possible to simultaneously expect separation of a super structure of the bridge from a seismic load and energy dissipation by the girder bridge protection device.

In a bridge structured to have movable ends, displacement of the super structure in the direction of a bridge axis may cause a problem. However, in the present invention, since sacrifice member constituting the girder bridge protection device according to the present invention limits the displacement of the super structure in the direction of the bridge axis to some extent, collision between adjoining vibration systems of the super structure can be prevented.

In a conventional bridge, as inertia force produced in a direction perpendicular to the bridge axis due to a seismic load is concentrated on a specific abutment restrained in the direction perpendicular to the bridge axis, the specific abutment is likely to be damaged or broken. However, in the present invention, since the behavior of the bridge in the direction perpendicular to the bridge axis is controlled only by the girder bridge protection device without the need of restraining the specific abutment in the direction perpendicular to the bridge axis, it is possible to prevent damage to the bridge, which is otherwise caused in the conventional art.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A girder bridge protection device comprising:

a sacrifice member including girders installed on an upper surface of a bridge seat of an abutment or pier to support a bridge floor, a symmetrical main support member connecting two of the girders and having an elongated tubular configuration, and an auxiliary support member projecting from one surface of a center portion of the main support member in a direction perpendicular to an axial direction of the main support member; and a restraining member secured to the bridge seat of the abutment or pier and including an accommodating section accommodating the auxiliary support member such that the auxiliary support member is separated from the accommodating section in a forward and rearward direction and in a leftward and rightward direction so as to control the auxiliary support member.

2. The girder bridge protection device according to claim 1, wherein the auxiliary support member is coupled to the main support member so as to define a closed loop.

3. The girder bridge protection device according to claim 2, wherein the auxiliary support member comprises:

a pair of connection sections connected to the main support member; and an accommodated section connecting the pair of connection sections with each other and positioned in the accommodating section of the restraining member.

4. The girder bridge protection device according to claim 3, wherein the accommodating section accommodates both auxiliary support members of two front and rear main support members installed on the same bridge seat.

5. The girder bridge protection device according to claim 4, wherein the two main support members commonly hold the one auxiliary support member.

6. The girder bridge protection device according to claim 1, wherein the auxiliary support member of the sacrifice member that is coupled to the main support member is bar-shaped.

7. The girder bridge protection device according to claim 6, wherein the auxiliary support member comprises:

an accommodated section in the shape of a bar that is positioned in the accommodating section of the restraining member; and a release prevention section formed at an end of the accommodated section to prevent release of the auxiliary support member from the restraining member.

8. The girder bridge protection device according to claim 1, wherein the main support member of the sacrifice member has a square sectional shape.

9. The girder bridge protection device according to claim 1, further comprises an elastic means member disposed between the auxiliary support member and the accommodating section.

10. The girder bridge protection device according to claim 9, wherein the elastic member comprises a leaf spring.

11. The girder bridge protection device according to claim 2, wherein the main support member of the sacrifice member has a square sectional shape.

12. The girder bridge protection device according to claim 3, wherein the main support member of the sacrifice member has a square sectional shape.

13. The girder bridge protection device according to claim 4, wherein the main support member of the sacrifice member has a square sectional shape.

14. The girder bridge protection device according to claim 5, wherein the main support member of the sacrifice member has a square sectional shape.

15. The girder bridge protection device according to claim 6, wherein the main support member of the sacrifice member has a square sectional shape.

16. The girder bridge protection device according to claim 7, wherein the main support member of the sacrifice member has a square sectional shape.

17. The girder bridge protection device according to claim 2, further comprising an elastic member disposed between the auxiliary support member and the accommodating section.

18. The girder bridge protection device according to claim 3, further comprising an elastic member disposed between the auxiliary support member and the accommodating section.

19. The girder bridge protection device according to claim 4, further comprising an elastic member disposed between the auxiliary support member and the accommodating section.

20. The girder bridge protection device according to claim 5, further comprising an elastic member disposed between the auxiliary support member and the accommodating section.

21. The girder bridge protection device according to claim 6, further comprising an elastic member disposed between the auxiliary support member and the accommodating section.

22. The girder bridge protection device according to claim 7, further comprising an elastic member disposed between the auxiliary support member of the sacrifice means and the accommodating section.

* * * * *